US011015392B2

(12) United States Patent
Slaughter, Jr. et al.

(10) Patent No.: US 11,015,392 B2
(45) **Date of Patent: *May 25, 2021**

(54) DUAL MEMBER PIPE JOINT FOR A DUAL MEMBER DRILL STRING

(71) Applicant: The Charles Machine Works, Inc., Perry, OK (US)

(72) Inventors: Greg L. Slaughter, Jr., Perry, OK (US); Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 246 days.

This patent is subject to a terminal disclaimer.

(21) Appl. No.: 16/219,584

(22) Filed: Dec. 13, 2018

(65) Prior Publication Data

US 2019/0136630 A1 May 9, 2019

Related U.S. Application Data

(63) Continuation of application No. 15/797,748, filed on Oct. 30, 2017, now Pat. No. 10,161,199, which is a continuation of application No. 14/704,150, filed on May 5, 2015, now Pat. No. 9,803,433, which is a continuation-in-part of application No. 13/951,797, filed on Jul. 26, 2013, now Pat. No. 9,765,574.

(60) Provisional application No. 62/009,424, filed on Jun. 9, 2014, provisional application No. 61/676,049, filed on Jul. 26, 2012.

(51) Int. Cl.

| | |
|---|---|
| ***E21B 7/06*** | (2006.01) |
| ***E21B 7/04*** | (2006.01) |
| ***E21B 17/18*** | (2006.01) |
| ***E21B 17/042*** | (2006.01) |
| ***E21B 7/20*** | (2006.01) |
| ***E21B 17/046*** | (2006.01) |
| ***E21B 7/00*** | (2006.01) |

(52) U.S. Cl.

CPC ..... *E21B 7/046* (2013.01); *E21B 7/002* (2013.01); *E21B 7/062* (2013.01); *E21B 7/20* (2013.01); *E21B 17/042* (2013.01); *E21B 17/046* (2013.01); *E21B 17/18* (2013.01)

(58) Field of Classification Search

CPC ..... E21B 7/046; E21B 7/002; E21B 7/062; E21B 7/20; E21B 17/042; E21B 17/046; E21B 18/18

See application file for complete search history.

(56) References Cited

U.S. PATENT DOCUMENTS

| | | | | |
|---|---|---|---|---|
| 5,490,569 | A | 2/1996 | Brotherton et al. | |
| 5,682,956 | A * | 11/1997 | Deken | E21B 6/00 175/19 |
| 6,439,319 | B1 | 8/2002 | Wentworth et al. | |
| 6,454,025 | B1 | 9/2002 | Runquist et al. | |
| 6,659,202 | B2 | 12/2003 | Runquist et al. | |

(Continued)

*Primary Examiner* — Yong-Suk (Philip) Ro

(74) *Attorney, Agent, or Firm* — Tomlinson McKinstry, P.C.

(57) ABSTRACT

A dual member drill string having a plurality of dual member drill string sections for use in horizontal directional drilling operations. Each drill string section having an outer member and an inner member that is rotatable independently of the outer member. The outer member has a pin end and a box end. The inner member has a pin end disposed within the pin end of the outer member and a box end disposed within the box end of the outer member.

16 Claims, 10 Drawing Sheets

(56) References Cited

U.S. PATENT DOCUMENTS

| | | | | |
|---|---|---|---|---|
| RE38,418 | E | 2/2004 | Deken et al. | |
| 7,025,152 | B2 | 4/2006 | Sharp et al. | |
| 7,216,724 | B2 | 5/2007 | Self et al. | |
| 7,389,831 | B2 | 6/2008 | Mullins et al. | |
| 7,694,753 | B2 | 4/2010 | Carlson et al. | |
| 8,201,644 | B2 | 6/2012 | Hall et al. | |
| RE44,427 | E | 8/2013 | Runquist et al. | |
| 8,534,388 | B2 | 9/2013 | Hall et al. | |
| 9,765,574 | B2 | 9/2017 | Slaughter, Jr. et al. | |
| 9,803,433 | B2 | 10/2017 | Slaughter, Jr. et al. | |
| 2005/0103527 | A1 | 5/2005 | Church et al. | |
| 2007/0272444 | A1* | 11/2007 | Carlson ..... | E21B 17/18 175/320 |
| 2009/0152011 | A1 | 6/2009 | Hall et al. | |
| 2013/0068490 | A1 | 3/2013 | Van Zee et al. | |
| 2014/0102799 | A1 | 4/2014 | Stringer et al. | |

* cited by examiner

DUAL MEMBER PIPE JOINT FOR A DUAL MEMBER DRILL STRING

FIELD

The present invention relates generally to boring machines and specifically to boring machines using dual member drill strings and to methods of boring horizontal boreholes using dual member drill strings.

SUMMARY

The present invention is directed to a pipe section for use in drill strings in rotary boring applications. The pipe comprises an elongate, hollow outer member having a pin end and a box end, wherein the pin end and the box end are correspondingly formed for torque-transmitting engagement. The pipe further comprises an elongate inner member disposed within the outer member and rotatable independently of the outer member. The inner member comprises a geometrically-shaped pin end, and a box end having a geometrically-shaped opening comprising at least one internal angle greater than 180 degrees. The pin end is slidably receivable in connector free torque-transmitting engagement with the box end of a similarly formed inner member.

The present invention is also directed to an elongate inner member section of a dual member drill string. The elongate inner member comprises a geometrically-shaped pin end, and a box end having a geometrically-shaped opening comprising at least one internal angle greater than 180 degrees. The pin end is slidably receivable in connector free torque-transmitting engagement with the box end of a similarly formed inner member section.

The present invention is further directed to a horizontal boring system comprising a rotary drilling machine and a drill string having a first end and a second end. The first end of the drill string is operatively connectable to the rotary machine to drive rotation of the drill string. The drill string comprises a plurality of pipe sections. Each pipe section comprises an elongate, hollow outer member having a pin end and a box end, wherein the pin end and the box end are correspondingly formed. The pipe further comprises an elongate inner member disposed within the outer member and rotatable independently of the outer member. The inner member comprises a geometrically-shaped pin end, and a box end having a geometrically-shaped opening comprising at least one internal angle greater than 180 degrees. The pin end is slidably receivable in connector free torque-transmitting engagement with the box end of an adjacent similarly formed inner member.

The present invention is also directed to a method for drilling a generally horizontal borehole using a dual member drill string comprising a plurality of dual member pipe sections, each dual member pipe section has an inner member comprising a geometrically-shaped pin end and a box end having a geometrically-shaped opening comprising at least one internal angle greater than 180 degrees. The inner member is disposed within an outer member comprising a pin end and a box end. The method comprises the steps of sliding the geometrically-shaped pin end of the inner member into the geometrically-shaped opening of the box end of a like inner member and orienting the geometrically-shaped pin end of the inner member such that the geometrically-shaped pin end engages with at least one internal angle greater than 180 degrees of the box end of the like inner member. The method further comprises the step of connecting the pin end of the outer member with the box end of a like outer member.

The invention disclosed herein is also directed to a drill string section for use in rotary boring applications. The drill string section comprises an elongate hollow outer member and an elongate inner member. The elongate, hollow outer member has a pin end and a box end. The pin end and the box end are formed for torque-transmitting engagement with a similarly formed adjacent outer member. The outer member has an inner surface forming a shoulder. The elongate inner member is disposed within the outer member and rotatable independently of the outer member. The inner member comprises a first pin end disposed within the pin end of the outer member and a second pin end disposed within the box end of the outer member. The inner member also comprises a first stop member disposed at the first pin end and a sleeve. The first stop member comprises a substantially planar surface defining a fluid passage between the first stop member and the shoulder of the outer member. The sleeve member comprises an interior surface corresponding to the first and second pin ends. The sleeve is held in place to the second pin end within the box end of the outer member and proximate a second stop formed on the inner member. The first pin end is slidably receivable in connector free torque-transmitting engagement with the sleeve member of an adjacent inner member.

The present invention is further directed to a pipe section of a dual member drill string comprising an elongate hollow outer member and an elongate inner member. The elongate, hollow outer member has a pin end and a box end. The pin end and the box end are correspondingly formed for torque transmitting engagement with an adjacent outer member. The elongate inner member is disposed within the outer member and rotatable independently of the outer member. The inner member comprises a first pin end disposed within the pin end of the outer member, a box end, and a first stop member. The box end is disposed within the box end of the outer member and comprises an opening configured to slidably receive the first pin end of an adjacent inner member in connector free torque-transmitting engagement. The first stop member is disposed proximate the first pin end and comprises a planar surface that defines a fluid flow passage.

Further still, the present invention is directed to a horizontal boring system comprising a rotary drilling machine and a drill string. The drill string has a first end and a second end. The first end is operatively connectable to the rotary machine to drive rotation of the drill string. The drill string comprises a plurality of pipe sections. Each pipe section comprises an elongate hollow outer member and an elongate hollow inner member. The elongate hollow outer member has a pin end and a box end. The pin end and the box end are correspondingly formed for torque transmitting engagement with an adjacent outer member. The elongate inner member is disposed within the outer member and rotatable independently of the outer member. The inner member comprises a first pin end and a box end. The first pin end is disposed within the pin end of the outer member. The box end is disposed within the box end of the outer member and has an opening to slidably receive the first pin end of an adjacent inner member in connector free torque-transmitting engagement.

DETAILED DESCRIPTION

Horizontal directional drills or boring machines may be used to replace underground utilities with minimal surface disruption. Horizontal directional drills may utilize single member drill strings or dual member drill strings to create the desired borehole. Drilling machines that use dual member drill strings are generally considered "all terrain" machines because they are capable of drilling through soft soil as well as rocks and rocky soil. Dual member drill strings comprise a plurality of dual member pipe sections. Each dual member pipe section comprises an inner member supported inside an outer member. The inner member is generally rotatable independent of the outer member. The inner member may be used to rotate the drill bit to excavate the formation, and the outer member is selectively rotated to align a steering mechanism to change the direction of the borehole while the rotating bit continues to drill. One such system is described in U.S. Pat. No. 5,490,569, entitled Directional Boring Head With Deflection Shoe, the contents of which are incorporated herein by reference. A suitable dual member drill string for use in horizontal directional drilling is disclosed in U.S. Pat. No. RE38,418, entitled Dual Member Pipe Joint For A Dual Member Drill String, the contents of which are incorporated herein by reference.

One method to connect dual member drill strings is by threading the inner members together and threading the outer members together. However, this method is time consuming. Another method is to connect the outer members using a threaded connection and connect the inner member using a non-threaded connection. This may be done by forming the ends of the inner members in a non-threaded geometric shape, such that the geometric-shape of the box end of the inner member corresponds with the geometric-shape of the pin end of a second inner member. The pin end of the inner member may slide axially into the box end of the second inner member to form a connector-free, torque-transmitting connection. In order to make this connection, the pin end and the box end are aligned before sliding the pin end into the box end. If the pin end and the box end are not aligned, the makeup process may be delayed, thus delaying drilling operations. Therefore, there remains a need for improved drill strings for use in horizontal directional drilling operations.

The present invention provides an improved connector-free, torque-transmitting connection for the inner members of a dual member drill string. The present invention allows for connection of the pin end and the box end of the inner member, while misaligned, during make-up of the dual member drill string. The present invention also provides an improved dual member pipe section configuration having a shorter length than previous dual member pipe sections.

Figure 1:
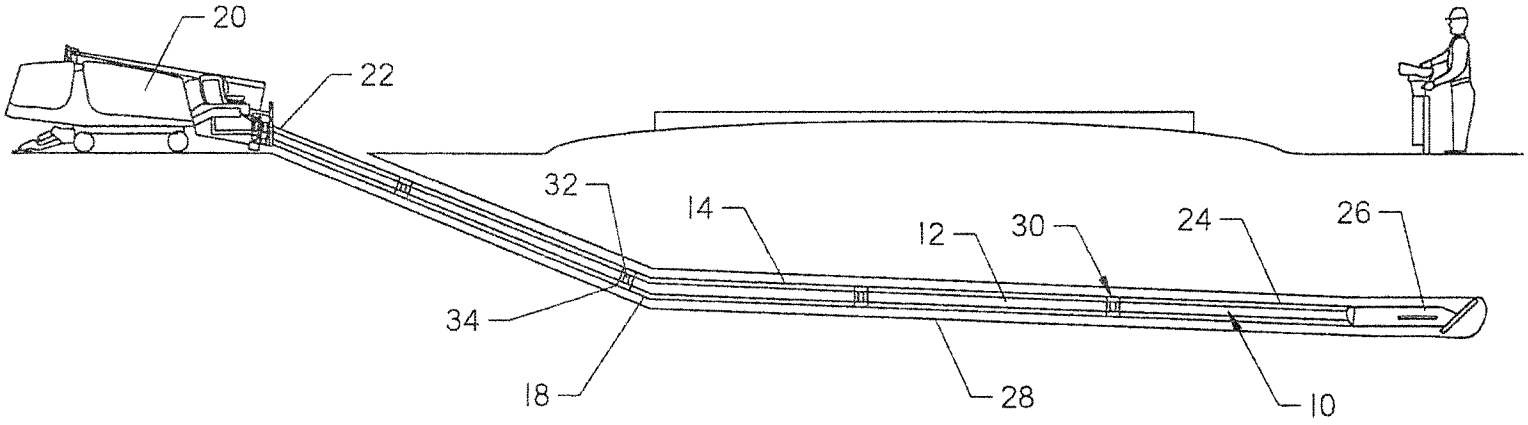
FIG. 1 is a diagrammatic representation of a horizontal directional drilling operation showing a cut-away view of the dual member drill string of the present invention.

Turning now to FIG. 1 there is shown therein a typical horizontal directional drilling operation. FIG. 1 depicts the use of a dual member drill string 10. In FIG. 1, the dual member drill string 10 is shown in a cut-away view and comprises an elongate inner member 12 disposed within an elongate, outer member 14. The dual member drill string 10 is made by connecting a plurality of dual member pipe sections 18 together at a plurality of dual member pipe joints 30. Each dual member pipe joint 30 comprises an inner member pipe joint 32 and an outer member pipe joint 34. The dual member pipe sections 18 are connected together or "made-up" at the ground surface utilizing a rotary boring machine 20. The dual member drill string 10 further comprises a first end 22 and a second end 24. The first end 22 of the dual member drill string 10 is operatively connected to the rotary boring machine 20 that is configured to rotate and thrust the drill string. The second end 24 of the dual member drill string 10 is connected to a downhole tool which may comprise a boring head 26 and tracking electronics 25. An above-ground tracker 27 may be used to determine the location of the boring head 26 as it is moved through the ground. The boring head 26 may comprise a steerable drill bit used to bore a borehole 28 through the ground with directional control or a backreamer used to enlarge a borehole.

Figure 2:
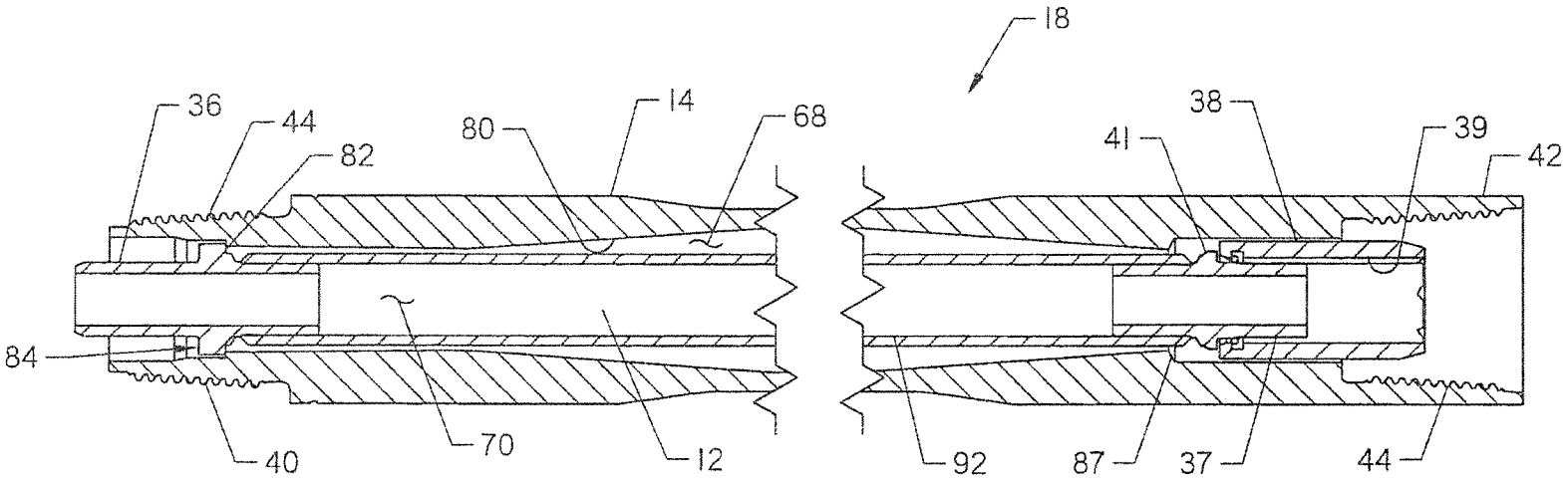
FIG. 2 is an illustration of one embodiment of a dual member pipe section from the dual member drill string shown in FIG. 1.

With reference now to FIG. 2, a dual member pipe section 18 from the dual member drill string 10 shown in FIG. 1 is shown in more detail. The outer member 14 is elongate and hollow. The outer member 14 has a pin end 40 and a box end 42. The pin end 40 and the box end 42 are correspondingly formed for torque-transmitting engagement with an adjacent outer member of the drill string 10 (FIG. 1). The outer member 14 has an inner surface 80 that forms a shoulder 82. The shoulder 82 is formed on the inner surface 80 at the transition between a region 83 (FIG. 10) having a first inner diameter that exceeds an outer diameter of a first stop member 84 and a second region 85 (FIG. 10) that has a second inner diameter that is less than or equal to the outer diameter of the first stop member 84. Thus, the first stop member 84 engages the shoulder 82 to limit axial movement of the inner member 12 relative to the outer member 14.

The inner member 12 is elongate and is disposed generally coaxially within the outer member 14. The inner member 12 is rotatable independently from the outer member. The inner member 12 comprises a first pin end 36 and a second pin end 37. The elongate inner member 12 may be either solid or comprise a central bore 70. A box end of the inner member may comprise a sleeve member 38 having an interior surface 39 corresponding to an outer surface of the first pin end 36 and the second pin end 37. The sleeve 38 may be held in place to the second pin end 37 within the box end 42 of the outer member 14 and proximate a second stop 41 formed on the inner member 12. The second stop member 41 may engage a second shoulder 87 formed on the inner surface 80 of the outer member 14 to limit axial movement of the inner member 12 relative to the outer member. In another embodiment shown in FIG. 10, second stop member 41 may be omitted or reduced in diameter to allow for removal of the inner member 12 from within the outer member 14. In such a configuration, a trailing end 108 of the sleeve 38 may engage the second shoulder 87 formed on the inner surface 80 of the outer member 14 to limit axial movement of the inner member 12 relative to the outer member.

The first pin end 36 of the inner member 12 is positioned within the pin end 40 of the outer member 14. The first pin end 36 is slidably receivable in connector free torque transmitting engagement with the sleeve member 38 of an adjacent inner member. The sleeve member 38 is disposed within the box end 42 of the outer member 14.

Figure 4:
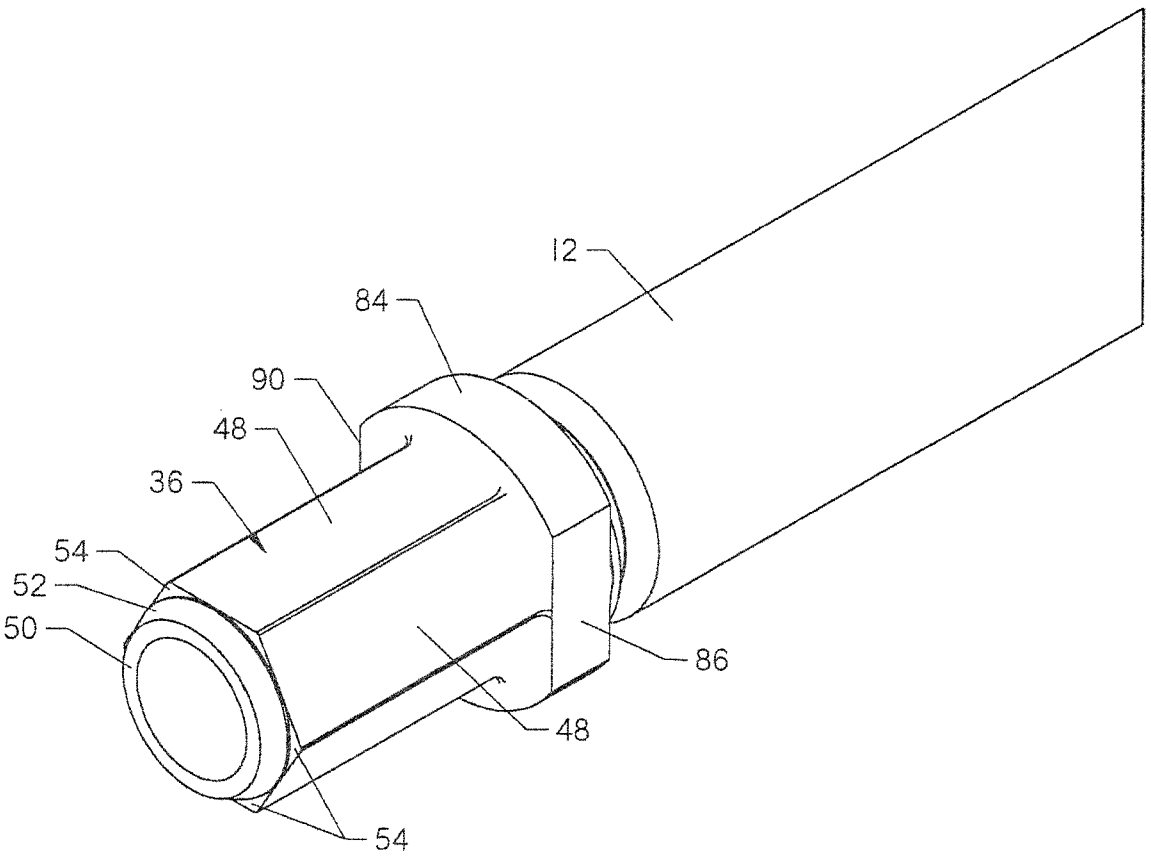
FIG. 4 is a perspective view of one embodiment of the pin end of the inner member of the dual member pipe section shown in FIG. 2.
Figure 9:
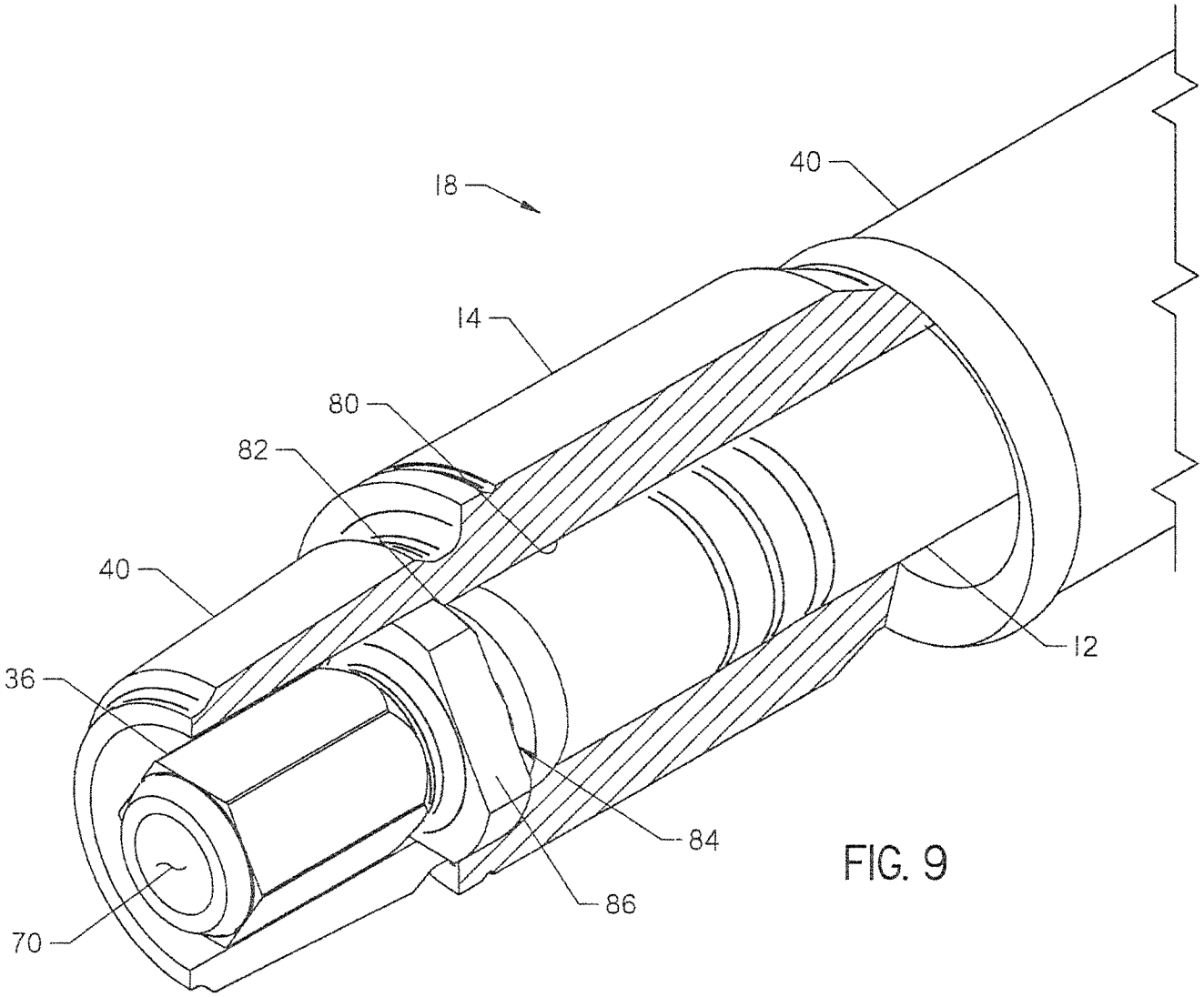
FIG. 9 is a perspective, partially cut away view of the pin end of the embodiment of the dual member drill pipe section shown in FIG. 2.

The first stop member 84 is disposed proximate the first pin end 36. As shown in FIG. 4, the first stop member 84 comprises a substantially planar surface 86 defining a fluid passage between the first stop member and the shoulder 82 of the outer member. The fluid passage allows drilling fluid to pass from the annular space 68 formed between the outer member 14 and the inner member 12 of one pipe section to an adjacent pipe section. FIG. 4 illustrates that the first stop member 84 may comprises at least two planar regions 86 and 90, disposed opposite each other, to define two fluid passages between the first stop member and the shoulder 82 of the outer member 14. In the embodiment of FIG. 9, the first stop member 84 has a profile comprising a triangle with truncated and curved apexes. Each of the truncated and curved apexes has a radius of curvature corresponding to a radius of curvature of the first inner diameter 83 (FIG. 10) of the outer member 14.

One skilled in the art will appreciate the first stop 84 and a second stop 41 disposed proximate the second pin end 37 may be integrally formed with the inner member 12 by machining the stop and its desired profile when manufacturing the inner member. Alternatively, the first stop member 84 and the second stop member 41 may be integrally formed with the first pin end 36 and the second pin end 37, respectively, which are then press fit into a tubular member 102 of the inner member 12 when the pipe section 18 is assembled. Further, second stop 41 may be omitted or sized to have an outer diameter that is less than the inner diameter of the outer member 14. In this configuration the trailing end 108 of the sleeve member 38 may engage the second shoulder 87 to limit axial movement of the inner member relative to the outer member 14.

Referring still to FIG. 2, the pin end 36 of the inner member 12 may be engaged with the box end 38 of an adjacent similarly formed inner member 12, forming the inner member pipe joint 32, as shown in FIG. 1. Similarly, the pin end 40 of the outer member 14 may be engaged with the box end 42 of an adjacent correspondingly formed outer member 14, forming the outer member pipe joint 34, as shown in FIG. 1. These connections or engagements together form the dual member pipe joint 30. The dual member drill string 10 is formed by creating a plurality of like dual member pipe joints 30.

The construction of the first pin end 36, the second pin end 37, and the sleeve 38 of the inner members 12, described herein, allows for single-action, "slip-fit" connection, or "connector-free" engagement of adjacent inner pipes when making up the inner members 12 of the dual member drill string 16. The pin end 40 of the outer member 14 and the box end 42 of an adjacent outer member 14 may be connected by corresponding threads 44, as shown in FIG. 2. During operation, the pin end 36 of the inner member 12 and the pin end 40 of the outer member 14 of each dual member pipe section 18 may be substantially simultaneously engageable to the box end 38 of the inner member 12 and the box end 42 of the outer member 14 of an adjacent similarly formed dual member pipe section 18. The inner member 12 may also be made up before the outer member 14. To enable a slip-fit connection the first pin end 36 and the second pin end 37 may have a hexagonal outer profile. The sleeve 38 or box end may have an inner profile that is hexagonal or any one of the alternative profiles disclosed in FIGS. 5, 6, and 7.

Figure 3:
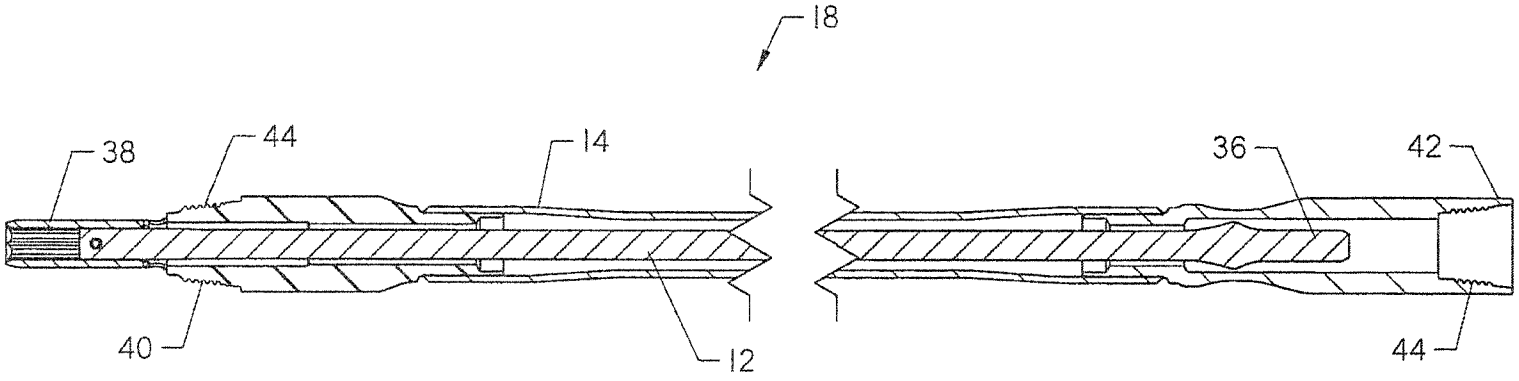
FIG. 3 is an illustration of an alternative embodiment of the dual member pipe section from the dual member drill string shown in FIG. 1.

Turning now to FIG. 3, an alternative embodiment of the dual member pipe section 18 is shown. The alternative embodiment provides for a longer dual member pipe section 18 which may be desired in some drilling operations. In FIG. 3, the pin end 36 of the inner member 12 is shown positioned within the box end 42 of the outer member 14 and the box end 38 of the inner member is shown positioned proximate the pin end 40 of the outer member. In this embodiment, the pin end 36 of the inner member 12 and the box end 42 of the outer member 14 may also be substantially simultaneously engageable to the box end 38 of an adjacent similarly formed inner member and to the pin end 40 of an adjacent similarly formed outer member.

Turning to FIG. 4, a perspective view of one embodiment of the pin end 36 of the inner member 12 is shown. The pin end 36 may comprise a geometric shape formed by a plurality of flat sides 48; preferably, the plurality of flat sides form a hexagon. However, any geometric shape which works to transmit torque will suffice. It will be understood that for purposes of this application, "geometrically shaped" does not include a circular shape because such shape would not allow torque transmission from one pipe joint 30 to the next.

Continuing with FIG. 4, the pin end 36 further comprises a front end 50. A frustoconical guide 52 is formed on the front end 50 of the pin end 36. The largest circumference of the frustoconical guide 52 is smaller than the smallest circumference of the plurality of flat sides 48. Due to this, the ends of the plurality of flat sides 48 form a plurality of alignment projections 54 that extend past the frustoconical guide 52. The alignment projections 54 aid alignment of the geometric feature of the pin end 36 with the geometric feature of the box end 38 of the inner members 12 to form the inner member pipe joint 32 (FIG. 1). This helps to lessen the likelihood that the pin end 36 will engage the box end 38 while misaligned, thus lowering potential hoop stress on the inner member pipe joint 32.

Figure 5:
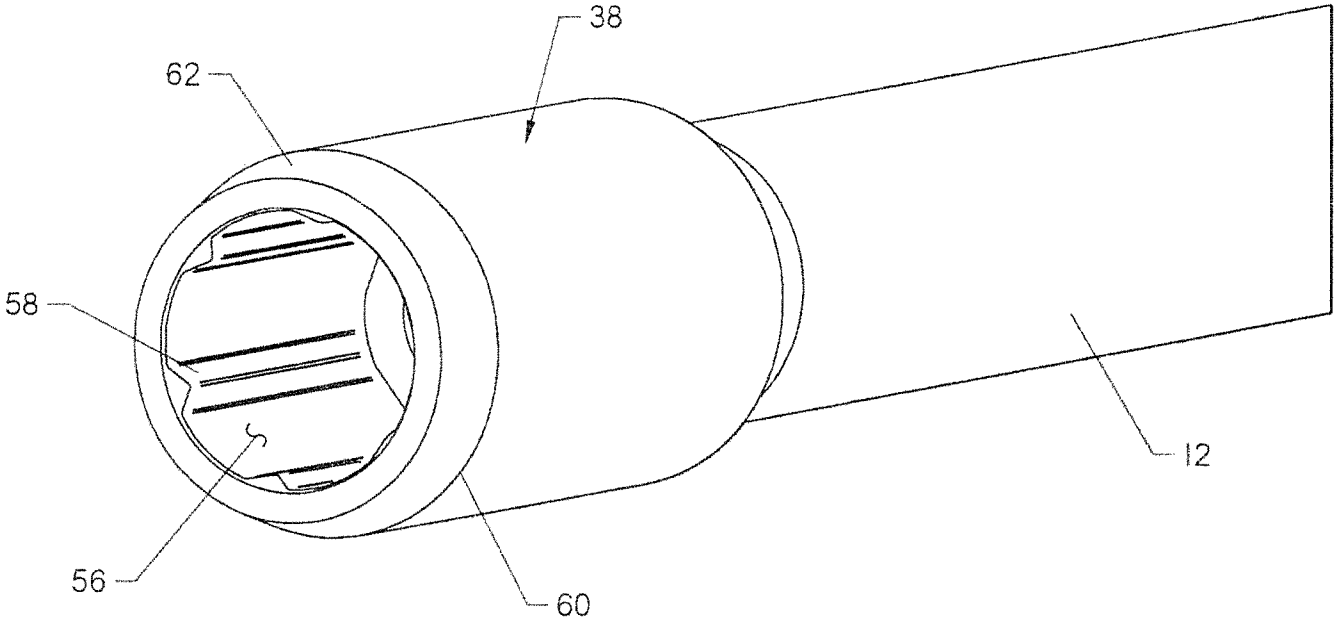
FIG. 5 is a perspective view of a box end of the inner member of the dual member pipe section shown in FIG. 2.

Turning to FIG. 5, the box end 38 of the elongate inner member 12 is shown in greater detail. The box end 38 comprises a central opening 56 having a geometric shape 58. The box end 38 further comprises a front end **6*o*. A tapered guide 62 may be inwardly formed at the front end 60 of the box end 38. The tapered guide 62 is complementary with the frustoconical guide 52 of the pin end 36 and helps to correctly align the pin end 36 and the box end 38** when the pin end is inserted into the box end.

Figure 6:
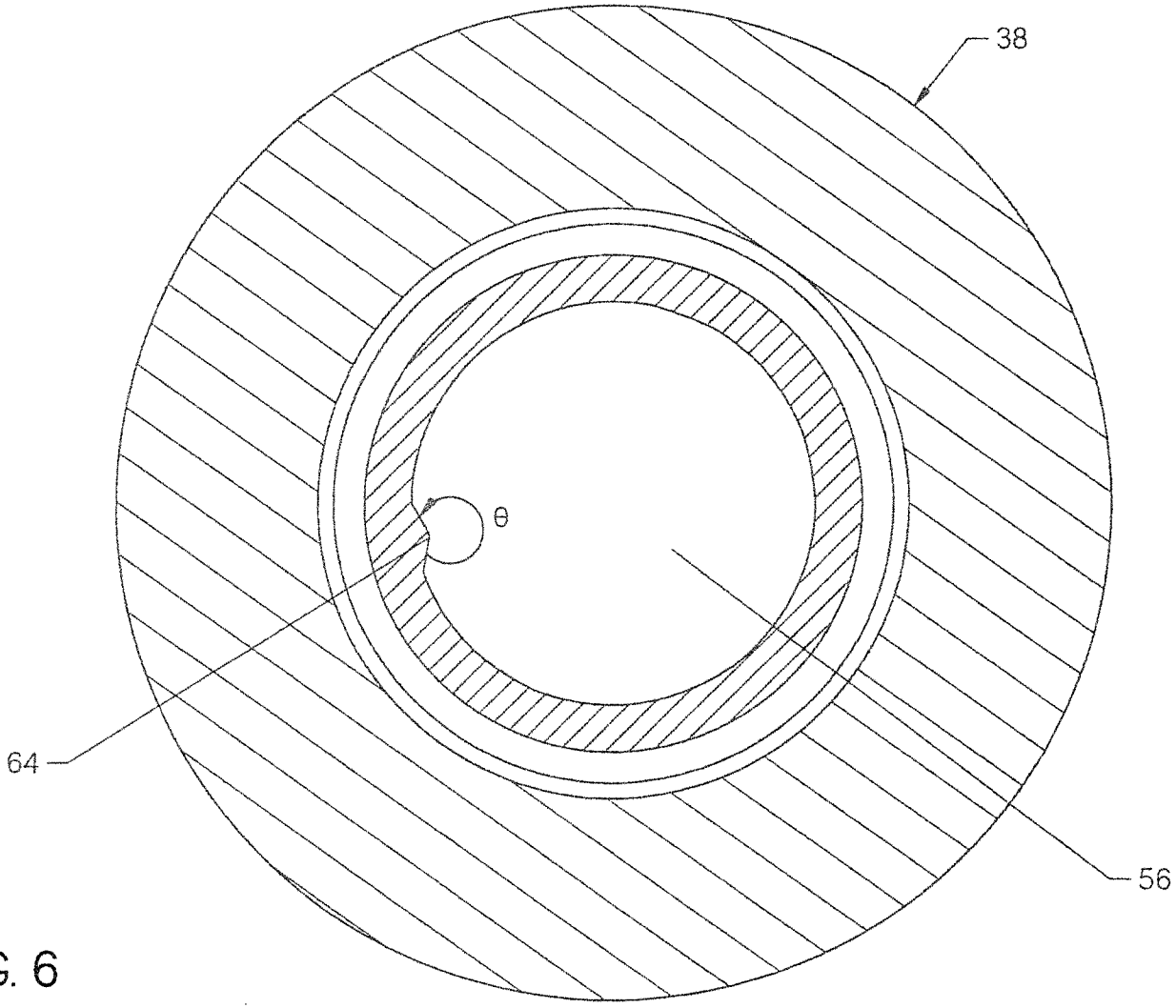
FIG. 6 is a cross-section view of one embodiment of the box end of the inner member.

Turning to FIG. 6, a cross-section view of one embodiment of the box end 38 of the inner member 12 is shown. The geometric shape of the box end 38 does not directly correspond with the geometric shape of the pin end 36 of the inner member 12. The geometric shape of the box end 38 comprises at least one internal angle θ greater than 180 degrees forming an internal projection 64. The term internal angle refers only to angles that may be measured within the inner circumference of the central opening 56, as shown by the arrow in FIG. 6. FIG. 6 shows a geometric shape that comprises only one internal projection 64.

Figure 7:
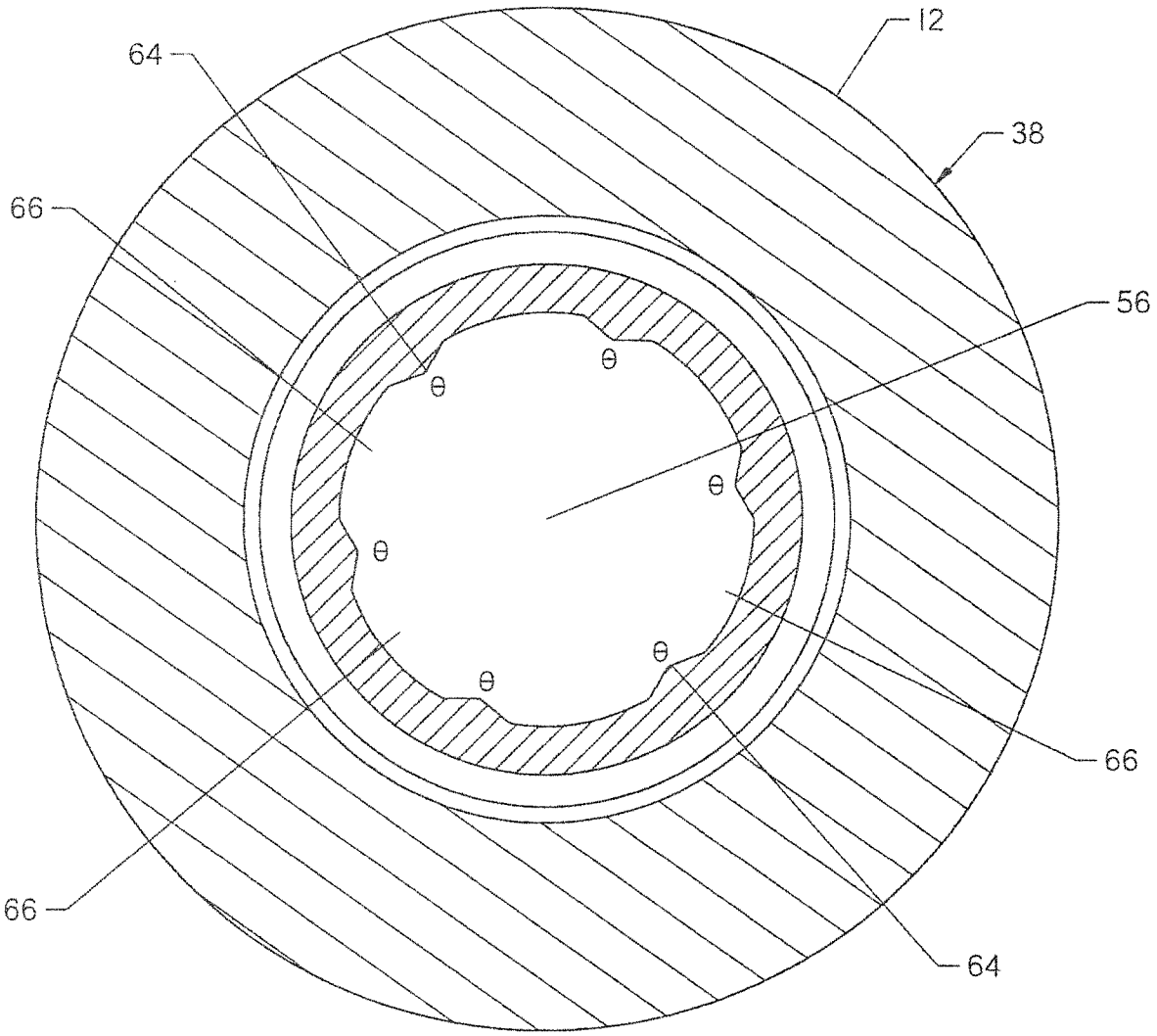
FIG. 7 is a cross-section view of an alternative embodiment of the box end of the inner member.

Turning to FIG. 7, a cross-section view of the box end 38 of the inner member 12 is shown comprising a plurality of internal projections 64. The geometric shape of the box end 38 may comprise the same number of internal projections 64 as corresponding flat sides 48 of the pin end 36 of the inner member 12 (FIG. 4). Thus, if the plurality of flat sides 48 form a hexagon, the geometric shape of the box end 38 will comprise six internal projections 64 formed from a plurality of internal angles θ greater than 180 degrees, as shown in FIG. 7.

Figure 8:
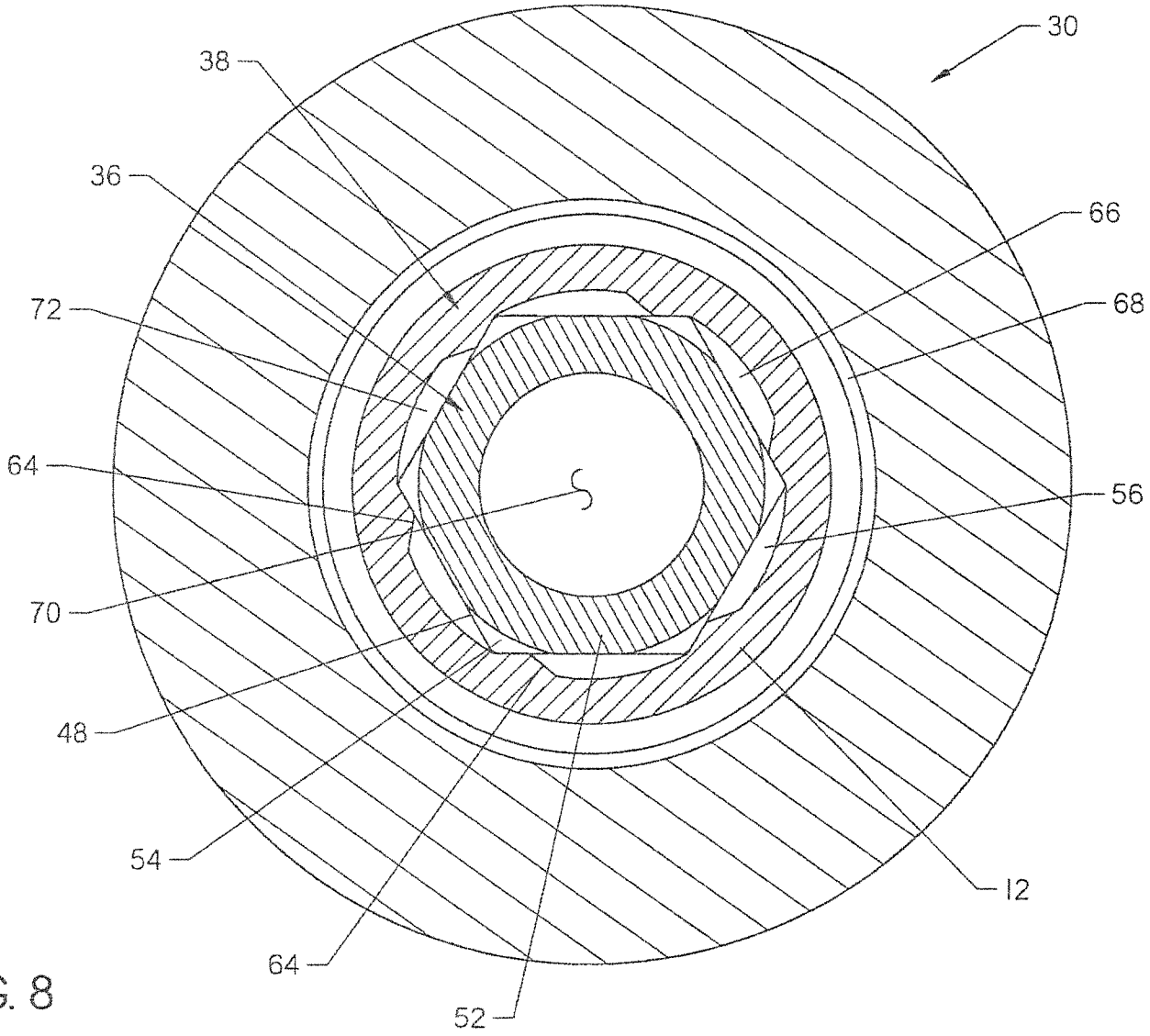
FIG. 8 is a cross-section view of the dual member pipe section showing the pin end of the inner member disposed within the box end of an adjacent inner member.

Continuing with FIG. 7, a plurality of spaces 66 are formed between the internal projections 64. The spaces 66 may be straight or curved. The spaces 66 between the internal projections 64 give the geometric shape 46 of the pin end 36 clearance to move once inserted into the box end 38 to engage the projections 64. The plurality of flat sides 48 of the geometric shape of the pin end 36 may shift until they contact the internal projections 64 of the box end 38, as seen in FIG. 8. Once the plurality of flat sides 48 engage the internal projections 64, the adjacent inner members 12 are capable of transferring torque to the newly connected inner member. Thus, the pin end 36 may be angularly misaligned with the box end 38 when the make-up process begins and the pin end is initially slid into the box end without preventing make-up of the inner members.

If only one internal projection 64 is present, as shown in FIG. 6, the flat sides 48 may move or shift once initially slid into the box end 38 until at least one of the flat sides 48 contacts the internal projection 64. The internal projections 64 may be positioned as desired to allow the greatest amount of misalignment and still maintain sufficient torque-transmitting engagement between the adjacent inner members 12.

Referring now to FIG. 8, a cross-section of the dual member pipe joint 30 is shown. FIG. 8 shows the pin end 36 disposed with the alternative embodiment of the box end 38 shown in FIG. 7. The pin end 36 is shown within the central opening 56 of the box end 38. An annular space 68 is shown between the inner member 12 and the outer member 14. Fluid may flow through the annular space 68 and down towards the directional boring head 26 (shown in FIG. 1) during drilling operations. The inner member 12 may also comprise a central bore 70, as shown in FIG. 8, or may comprise a solid rod. Fluid may also pass through the central bore 70 during drilling operations.

FIG. 8 also shows the geometric shape of the box end 38 having six internal projections 64.

Six flat sides 48 forming the geometrically-shaped pin end 36 are shown engaged with the projections 64. Six spaces 66 between the projections 64 provide clearance for the flat sides 48 to move or shift as needed to properly engage the internal projections. Torque-transmitting engagement between the pin end 36 and the box end 38 occurs when the flat sides 48 engage the internal projections 64. This torque transmitting engagement permits the inner member 12, when interconnected, to drive rotation of the drill bit. A plurality of passages 72 are created between the flat sides 48 and the spaces 66 when the flat sides are engaged with the internal projections 64. The passages 72 provide additional space for fluid to flow through the drill string 16 and down towards the directional boring head during drilling operations (FIG. 1).

In operation, the geometrically-shaped pin end 36 of the inner member 12 will be slid into the geometrically-shaped opening of the box end 38 of an adjacent inner member. The geometrically-shaped pin end 36 will then be oriented such that it engages with at least one internal projection 64 formed from the at least one internal angle θ greater than 180 degrees of the geometrically-shaped box end 38 of the adjacent inner member. The pin end 40 of the outer member 14 is subsequently or simultaneously connected to the box end 42 of an adjacent outer member. The outer members 14 may be connected by threading the pin end 40 of the outer member to the box end 42 of the outer member.

Turning now to FIG. 9, a perspective view of the pin end 40 of the drill pipe section 18 of FIG. 2 is shown with a portion of the outer member 14 cut away to reveal the pin end 36 of the inner member 12. As previously discussed, the pin end 40 of the outer member may be threaded for torque transmitting engagement with a corresponding internally threaded adjacent outer member. The outer member 14 has an inner surface 80 forming an annular shoulder 82. First stop member 84 is configured to engage the shoulder 82 to limit axial movement of the inner member 12 relative to the outer member 14.

The elongate inner member 12 is disposed within the outer member 14 and rotatable independently of the outer member. The inner member 12 comprises the first pin end 36 disposed within the pin end 40 of the outer member 14. The first stop member 84 is disposed proximate the first pin end 36 of the inner member 12. The first stop member 84 comprises a substantially planar surface 86 that defines a fluid passage between the first stop member and the shoulder 82 of the outer member 14. The first pin end 36 may have an outer hexagonal profile to facilitate connector free torque transmitting engagement with a correspondingly formed sleeve member 38 forming a box end of the inner member 12. The first pin end 36 and the second pin end 37 may have identical profiles. They may both have hexagonal outer profiles and both may comprise a frustoconical guide 52 to direct the pin ends into the sleeve member 38.

Figure 10:
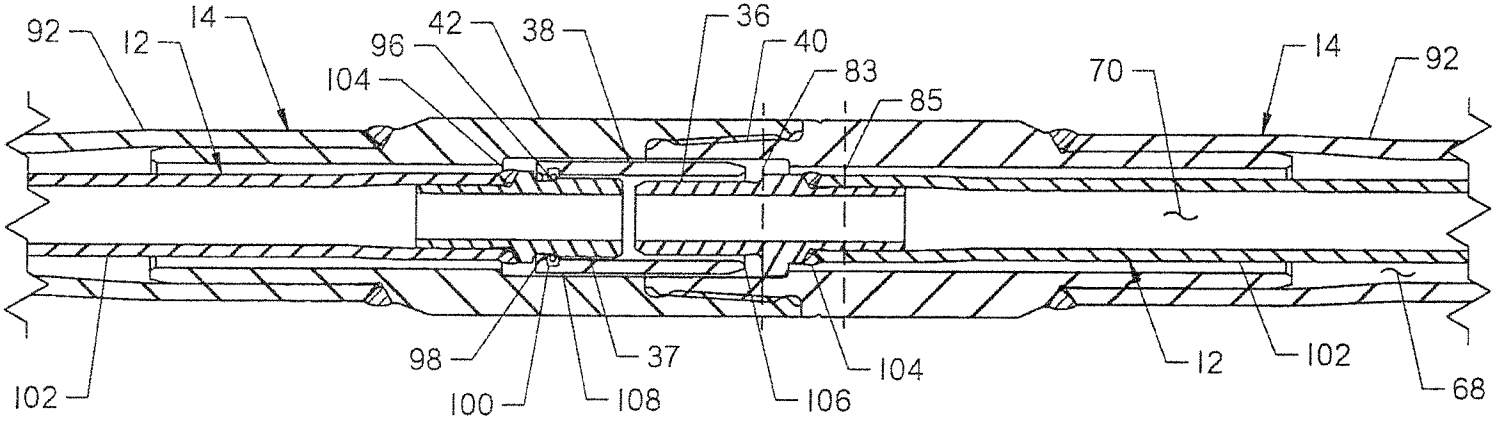
FIG. 10 is a longitudinal section view of a dual member drill string pipe joint of the drill pipe embodiment of FIG. 2.

Turning now to FIG. 10, the embodiment of pipe section 18 shown in FIGS. 2 and 9 is shown connected to an adjacent dual member drill string section. Outer member 14 is connected to the outer member 14 of an adjacent pipe section to form an outer casing extending from the drilling machine to the downhole tool assembly. Torque and thrust/pullback is transmitted between outer members 14 via the connection between externally threaded pin end 40 and internally threaded box end 42. The box end 42 may be integrally formed with tubular member 92 or, as shown in FIG. 10, press fit into tubular member 92 and welded in place. Likewise, pin end 40 may be integrally formed with tubular member 92 or may be press fit into tubular member 92 and welded into place. An important feature of pin end 40 is inner diameter 83. Inner diameter 83 must be large enough to accommodate sleeve member 38 within the pin while permitting pin end 40 to fit within box end 42. Thus, inner diameter 83 is larger than the outer diameter of the sleeve member 38.

Inner member 12 is shown connected to an inner member 12 of an adjacent pipe section. The first pin end 36 is disposed within sleeve member 38. The sleeve member 38 is held in place to the second pin end 37. The sleeve member may be held in place using a snap ring 96 disposed in a groove 98 formed in the second pin end 37 and a corresponding internal groove 100 formed in the sleeve member 38. Both the first pin end 36 and the second pin end 37 may be integrally formed with a tubular member 102. Alternatively, as shown in FIG. 10, the pin ends 36 and 37 may be press fit into upset ends of the tubular member 102 and welded into place at weldment 104. Inner members 12 having first stop members 84 and second stop members 41 with profiles discussed herein with reference to FIGS. 4 and 9 may be used interchangeably without departing from the spirit of the invention.

The sleeve member 38 may have a generally circular exterior surface with at least one fluid flow passage formed in the exterior surface. Preferably, a plurality of fluid flow passages are machined into the exterior surface to allow drilling fluid to pass between pipe sections in the annulus 68 formed between the outer member 14 and the inner member 12. The sleeve 38 may also comprise a leading end 106 and a trailing end 108. The leading end 106 has a smaller outer diameter than the trailing end 108. The leading end 106 and the trailing end 106 may be connected by a sloped transition portion. The leading end 106 having a sloped portion with a smaller diameter helps to guide sleeve member 38 into the pin end 40 of the outer member during make-up of the pipe joint. As previously discussed, the trailing end 108 may engage the second shoulder 87 to limit axial movement of the inner member 12 relative to the outer member 14. The sleeve member 38 may have an internal profile comprising a hexagon or alternatively any one of the internal profiles shown in FIGS. 5, 6, and 7.

Various modifications can be made in the design and operation of the present invention without departing from its spirit. Thus, while the principle preferred construction and modes of operation of the invention have been explained in what is now considered to represent its best embodiments, it should be understood that within the scope of the appended claims, the invention may be practiced otherwise than as specifically illustrated and described.

The invention claimed is:

1. A drill string section comprising:

an elongate, hollow outer section having a pair of opposed ends, each end formed for torque-transmitting engagement with an end of an adjacent outer section, the outer section having an inner surface forming a first shoulder; and an elongate inner section at least partially disposed within the outer section and rotatable independently of the outer section, the inner section comprising:

a body having opposed first and second ends;

an enlarged first stop element formed adjacent the first end of the body and engagable with the first shoulder, the first stop element defining a boundary of a longitudinal fluid passage situated between the inner and outer sections; and a sleeve having opposed first and second ends, the first end receiving the second end of the body in torque-transmitting engagement and the second end configured to receive the first end of the body of an adjacent inner member in torque-transmitting engagement.

2. The drill string section of claim 1 wherein the first end of the body has the shape of a conical frustum.

3. The drill string section of claim 1 in which the elongate section has a circular cross-sectional profile.

4. The drill string section of claim 1 in which the body is hollow and further comprising a first pin member press fit into the body at the first end of the body.

5. The drill string section of claim 1 further comprising a first pin member welded to the body at the first end of the body.

6. The drill string section of claim 1 in which the first stop member comprises at least two non-contiguous longitudinal flow passages situated between the inner and outer sections.

7. The drill string section of claim 6 wherein the non-contiguous flow passages are bounded by a planar region formed on the stop element.

8. The drill string section of claim 1 in which an external groove is formed in the body adjacent the second end, and in which a retainer is received within the external groove and joins the sleeve to the body.

9. The drill string section of claim 8 in which an internal groove is formed in the sleeve and the retainer is received within both the internal and external grooves.

10. The drill string section of claim 8 in which the retainer comprises a snap ring member.

11. The drill string section of claim 8 in which the internal groove of the sleeve is circumferential.

12. An elongate inner member comprising:

a body having opposed first and second ends, each of the ends having an external surface;

a groove disposed at the second end;

a sleeve member comprising an interior surface corresponding to the external surface of the first and second ends and an internal groove, wherein the first end is slidingly receivable in connector free torque-transmitting engagement with the sleeve member of an adjacent inner member; and a retainer disposed in the internal groove and the groove at a second pin end to hold the sleeve member in place relative to the second pin end.

13. The inner member of claim 12 in which the retainer is a snap ring.

14. The inner member of claim 12 in which the body has a circular cross-sectional profile.

15. The inner member of claim 14 in which the first and second ends each define a hexagonal cross-sectional profile.

16. The inner member of claim 15 in which the inner surface of the sleeve member has at least one raised longitudinal ridge formed thereon.

* * * * *